US005335603A

United States Patent [19]

Wirick et al.

[11] Patent Number: 5,335,603

[45] Date of Patent: Aug. 9, 1994

[54] TOP CHORD TO INSIDE CONNECTION FOR GONDOLA CAR

[75] Inventors: Cloyd Wirick, Mineral Point; Joseph Majcher, Johnstown, both of Pa.

[73] Assignee: Johnstown America Corporation, Chicago, Ill.

[21] Appl. No.: 47,398

[22] Filed: Apr. 19, 1993

[51] Int. Cl.[5] ..... B61D 17/00

[52] U.S. Cl. ..... 105/406.1; 105/411

[58] Field of Search ..... 105/396, 404, 406.1, 105/406.2, 407, 409, 410, 411; 296/181, 29; 52/262, 263, 653.1

[56] References Cited

U.S. PATENT DOCUMENTS

| | | | |
|---|---|---|---|
| 1,308,300 | 7/1919 | Sage | 105/406.1 |
| 1,537,050 | 5/1925 | Campbell | 105/406 R |
| 1,559,025 | 10/1925 | Anderson et al. | 105/406 R |
| 1,605,943 | 11/1926 | Hart | 105/406.1 |
| 1,698,867 | 1/1929 | Wine | 105/406 R |
| 1,834,264 | 12/1931 | Wine | 105/411 |
| 1,894,721 | 1/1933 | Wine | 105/406.1 |
| 2,033,566 | 3/1936 | Wine | 105/406.1 |
| 2,104,359 | 1/1938 | Wine | 105/406 R |
| 2,235,449 | 3/1941 | Ditchfield | 105/409 |
| 4,561,361 | 12/1985 | Adams | 105/406 R |
| 4,930,427 | 6/1990 | Ritter et al. | 105/406.1 |

FOREIGN PATENT DOCUMENTS

| | | | |
|---|---|---|---|
| 0091978 | 5/1958 | Norway | 296/29 |

*Primary Examiner*—Mark T. Le

[57] ABSTRACT

A connection members for attaching the upper portion of an inside stake of a gondola car to the upper chord and to the side wall. A pair of connection members are employed on the upper portion of the inside stake and compliment its configuration. Bolt and nut assemblies affixed the connection members to the upper portion of the inside stake member and the upper chord.

8 Claims, 2 Drawing Sheets

FIG. 1
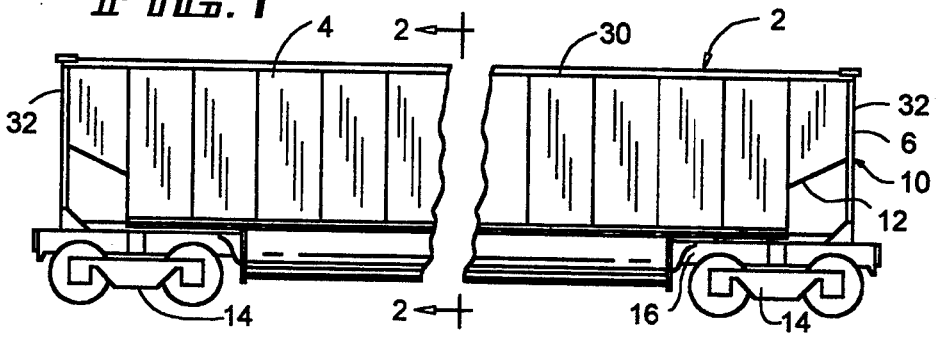
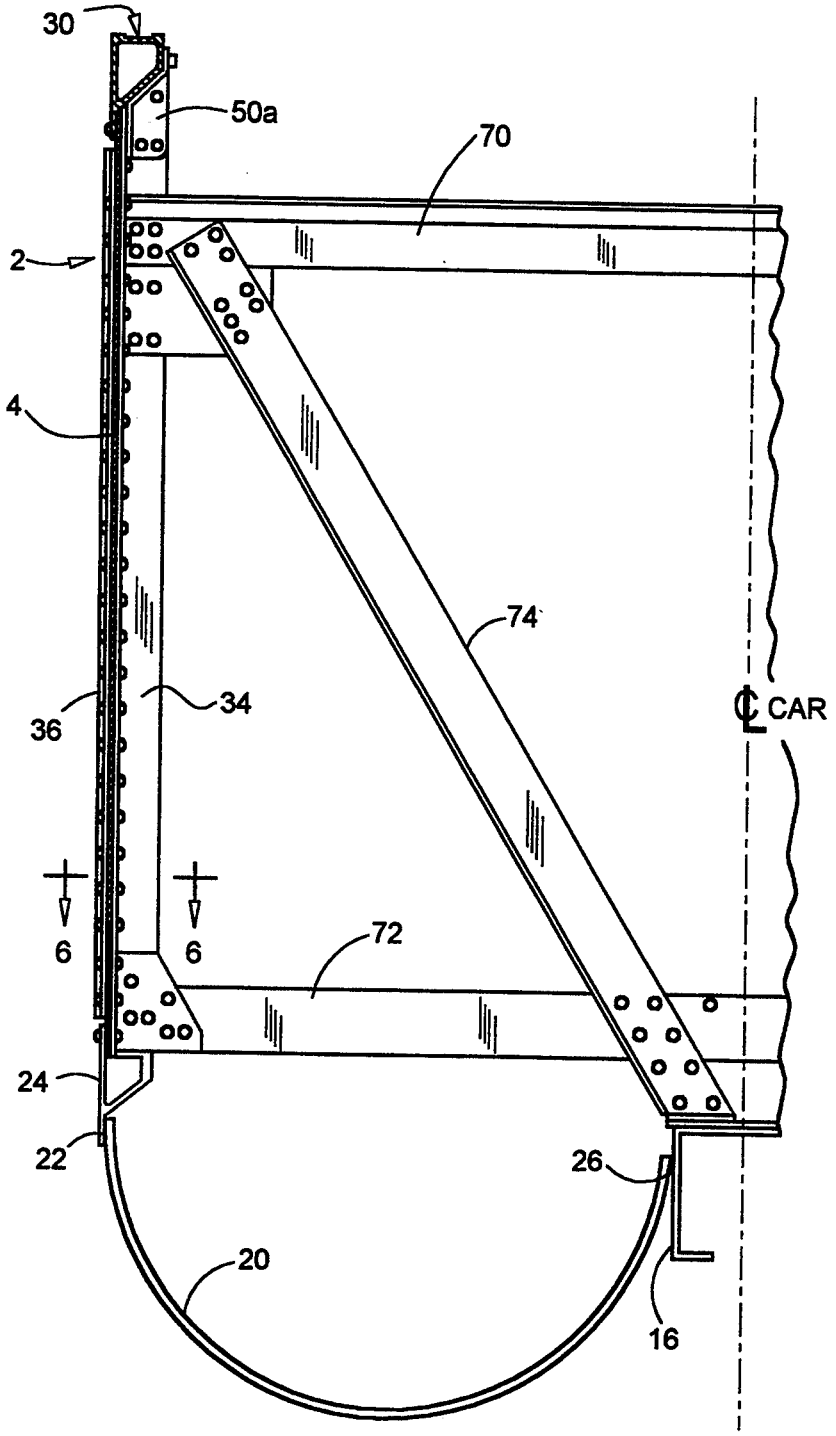
FIG. 2

TOP CHORD TO INSIDE CONNECTION FOR GONDOLA CAR

BACKGROUND OF THE INVENTION

1. Field of the Invention

This invention relates in general to an inside stake gondola rail cars and more particularly, to an improved top chord to inside stake connection.

2. Summary of the Prior Art

Gondola rail cars are commonly used to carry bulk materials, such as coal, sand, gravel, or the like. One type of gondola car employs concave floor panels with side stakes places to the inside which significantly increase the load carrying volume of the car. The sides of a gondola car include a side sheet and side stake members which are connected to top and bottom chords through welding in the prior art. During ordinary loaded service, the side sheet and side stake members in known gondola cars tend to deflect outward of the car at the mid spans. This deflection is due to the horizontal pressure of the lading loads. Such outward deflection in turn causes the top of the side stakes to tend to rotate inward and down with the side stake tops separating away from top chord member. The side stake top rotates about the row of fasteners which connect the top chord, side sheet, and side stakes together in existing cars. Such rotation overstresses the bottom extension of the top chord member and the flanges of the side stakes resulting in eventual cracking. Accordingly, it is desirable to improve existing gondola cars by providing a more positive connection and preventing the side stake top from rotating away from the top chord to reduce stresses and eventual cracking in both the top chord member and the flanges of the side stake.

SUMMARY OF THE INVENTION

It is therefore an objective of the invention to provide a more positive connection between the top of the side stake and the top chord extending longitudinally along a gondola car. The railcar super structure of the invention is constructed with the side stakes to the inside of the car and side sheets at the exterior to maximize carrying capacity and provide a more aerodynamic car design. The unique connection of the invention employs a bolted attachment of the side stake to the top chord rather than using welded connections as is prior art. The casting connection of the invention serves to prevent overstressing in the top chord bottom extension and side stake flanges due to outward deflections of the side stakes. Separation between the side stake tops and top chord member can also be experienced during rotary dumping operations. Rotary dump clamp forces developing during rotary dumping operation cause a downward force on the top chord members which in turn cause an additional rotation at the top chord to side stake fasteners. The casting connection provides for a more direct transfer of load between the top chord and side stakes and prevents the additional rotation from occurring.

BRIEF DESCRIPTION OF THE DRAWINGS

FIG. 1 is a side elevational view of an inside stake gondola car having the improved top chord to side stake connection of the invention;

FIG. 2 is an end elevational view, with parts broken away, taken along lines 2—2 of FIG. 1;

DESCRIPTION OF THE PREFERRED EMBODIMENT

Figure 3:
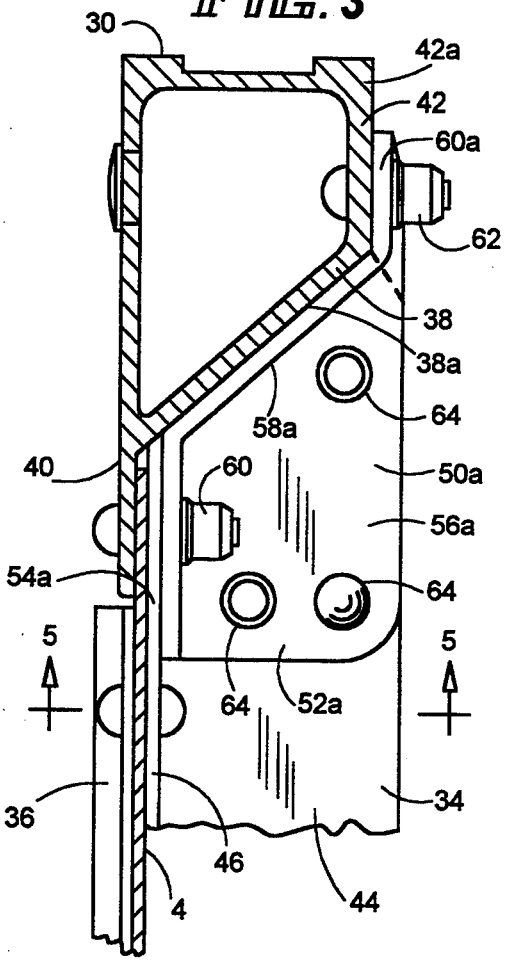
FIG. 3 is a enlarged partial end elevational view, with parts broken away, of the top chord to inside stake connection of the invention.

Referring to FIG. 1, there is illustrated an inside stake gondola type rail car for carrying commodities, such as bulk materials in the form of coal, sand, gravel and the like, and generally designated by reference numeral 2. The gondola car 2 includes a pair of vertical side walls in the form of side sheets 4 and a pair of end walls and floor 6. The end walls and floor 6 have upper portions 10 and lower portions 12 which extend over conventional car trucks 14 and distribute portions of the end loading. As seen in FIGS. 1 and 2, a center sill 16 having a boxed beam shape extends substantially the full length of the car 2 between the trucks 14 and provides a support structure for concave floor panels 20 in the form of a pair of tubs extending longitudinally on each side for substantial length along center sill 16. The pair of tubs 20 are affixed along outer edge portions 22 to the longitudinal side sill or bottom chord 24 as seen in FIG. 2. The inner edges 26 of tubs 20 are welded or bolted to respective sides of the center sill 16 which is also seen in FIG. 2.

Figure 4:
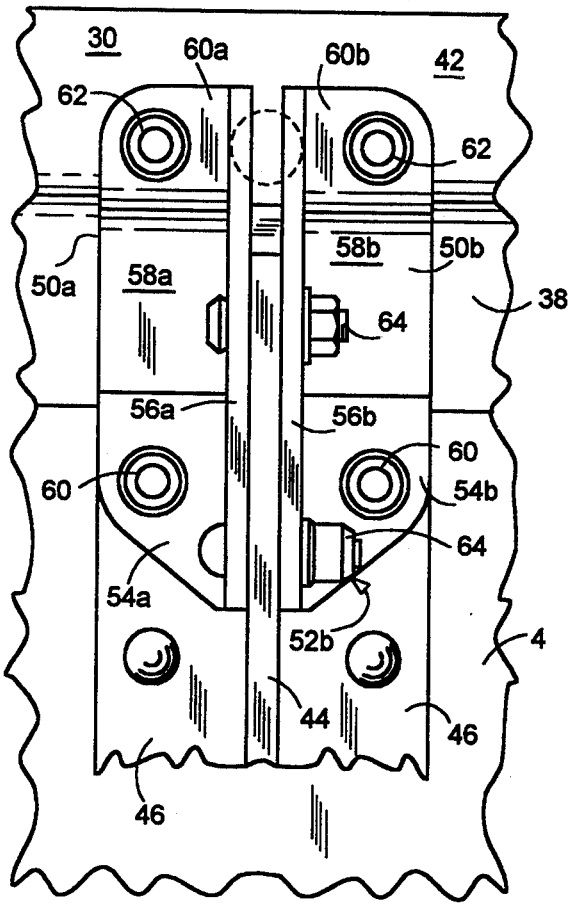
FIG. 4 is an enlarged partial side elevational view of the side sheet showing the top chord to inside stake connection of the invention.
Figure 5:
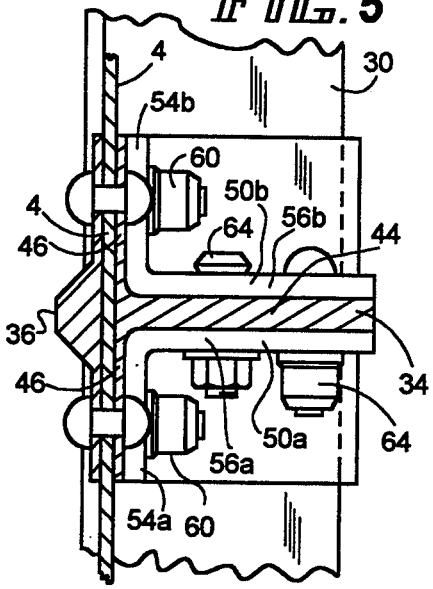
FIG. 5 is a top partial plan view, with parts broken away, taken along lines 5—5 of FIG. 3.
Figure 6:
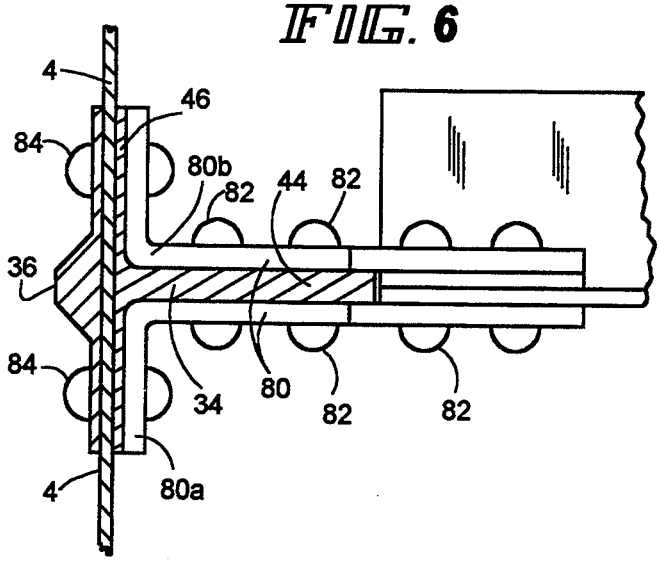
FIG. 6 is a top plan view, with parts in section, taken along lines 6—6 in FIG. 2.

A pair of top chord members 30 extend on both sides of gondola car 2 between corner posts 32. The top chord member 30 is formed with a hollow construction having an approximate trapezoidal cross section configuration. The plurality of vertical inside stake members 34 are affixed to the inside surface of side sheets 4 and are connected respectfully at their top to the top chord 30 and at their bottom to the bottom chord 24 in a manner to be described later. As seen in FIGS. 4, 5, and 6, the vertical inside stake members have a generally T-configuration in cross section with a lateral portion 44 extending perpendicularly from side sheet 4 and a longitudinal portion 46 disposed in contacting relation to the inside of side sheet 4. A plurality of spaced outside vertical stake members 36 are riveted to the outside wall of side sheet 4 and extend substantially the height of the side sheets 4 as best seen in FIGS. 2, 3, 5, and 6. As seen in FIG. 3, the bottom wall 38 of top chord 30 provides a lower sloped face **38*a* which terminates with a downward extending flange portion 40. The upper inside portion 42 of chord 30 provides a vertically disposed upper face 42*a***.

Each of the inside stake members 34 are affixed to the top chord 30 by means of a pair of connection castings **50*a* and 50*b* disposed in sandwiched and matching relation to the top portion of inside side stake 34 as best shown in FIGS. 3, 4, and 5. The connection castings 50*a* and 50*b* are formed with bottom portions 52*a*, 52*b* having respective longitudinally extending flanges 54*a* and 54*b* and a laterally extending lower portions 56*a* and 56*b*. As seen in FIGS. 3, 4, and 5, longitudinal flanges 54*a*, 54*b* have a surface disposed in bearing relationship to a part of longitudinal portion 46 of the inside side stake 34. Sloped intermediate portions 58*a*, 58*b* of the connection castings 50*a*, 50*b* are integrally connected to longitudinal flanges 54***a*, 54*b* and lateral lower portions 56*a*, 56*b* and extend upward in a sloped orientation in contacting relationship to the face 38*a* of sloped bottom wall 38 of the top chord 30. The connection castings 50*a*, 50*b* include upper vertical flange portions 60*a*, 60*b* disposed in a vertical plane in bearing relationship to vertical face 42*a* of chord 30. From the foregoing, it should be clear that the configuration of casting 50*a* and 50*b* is designed to have portions in bearing contact with the vertical face 42*a* and to the sloped bottom wall 38*a* of chord 30. In addition, longitudinal portions 54*a*, 54*b* and lateral portions 56*a*, 56*b* are in contact respectively with the top of longitudinal portion 46 and the top of lateral portion 44 of inside stake 34.

As seen in FIG. 4, the pair of connection castings 50*a* and 50*b* are arranged with the lateral portion 44 of the side stake 34 being sandwiched between lateral portions 56*a* and 56*b*. A drive bolt and nut assembly 60 extends through longitudinal portions 54*a*, 54*b*, chord flange 40, side sheet 4, and inside side stake 34 to attach the foregoing components together. A drive bolt and nut assembly 62 is also provided through the inside wall 42 of the upper chord 30 and the upper portions 60*a*, 60*b* of each connection castings 50*a*, 50*b* as seen in FIG. 4. The lateral portions 56*a*, 56*b* of connection castings 50*a*, 50*b* are affixed in sandwiched relation to inside side stake 44 by a plurality of bolt and nut assemblies 64.

As shown in FIG. 2, the gondola car 2 includes an interior frame structure at least two longitudinal positions comprising an upper cross frame member 70 and a lower cross frame member 72 interconnected by diagonal member 74 on both sides of center sill 16. The upper cross member is affixed by bolted fasteners 76 to a selected inside side stake 44 at a position beneath connection castings 50*a*, 50*b*. Although not intended to be so limited, it is advantageous that connection castings 50*a*, 50*b* be employed to connect the inside side stake 44 and upper chord 30 at least on the inside side stakes to which the cross frame are affixed. Separation between the side stake top and top chord member is most severe at these locations due to additional loadings on the side stakes from the K-frame structure.

The lower cross frame member 72 is affixed to the side stake 44 by L-shaped plates 80 as seen in FIGS. 2 and 6. The plates 80*a*, 80*b* are attached by plurality bolt members 82 to the cross frame member 72. In addition, bolt assemblies 84 extend through the side sheet 4, inside side stake 44, and the plates 80.

What is claimed is:

1. A rail car comprising body means having a vertical side sheet forming an interior longitudinal wall, a vertical side stake vertically arranged in contact with said interior longitudinal wall, said vertical side stake having a lateral wall and a longitudinal wall in contact with said interior longitudinal wall, top chord arranged along the top portion of said vertical side sheet and having a vertical face lying in generally parallel spaced relationship to said interior longitudinal wall of said side sheet, connection means interconnecting said side sheet, said vertical side stake, and said top chord, said connection means having a first portion in contact with said lateral wall of said side stake along a lateral plane relative to said interior longitudinal wall, said connection means further having a second portion in contact with said vertical face of said upper chord, attachment means affixing said first portion, said second portion, and said third portion of said connection means to said side sheet, said lateral wall of said side stake, said vertical face of said upper chord and said longitudinal wall of said side stake; and said upper chord including a sloped bottom wall extending below said vertical face, said connection means having an intermediate portion, between said second portion and said third portion, in contacting relationship to said sloped bottom wall.

2. The rail car according to claim 10 wherein said connection means includes a pair of connection members, each of said connection members having said first portion in bearing contact with said lateral wall of said side stake and said second portion being in bearing contact with said vertical face, said attachment means including first bolt means affixing said first portion to said lateral wall of said side stake, and second bolt means affixing said second portion to said vertical face of said upper chord.

3. The rail car according to claim 1 wherein said side stake includes a generally T-shaped cross-sectional configuration.

4. The rail car according to claim 3 wherein said connection means includes a pair of connection members affixed on opposite sides of said side stake.

5. The rail car according to claim 4 wherein said pair of connection members have a configuration complementary to the T-shaped configuration of said side stake.

6. The rail car according to claim 1 wherein said attachment means includes first bolt means extending through said first portion of said connection means and said lateral wall of said side stake.

7. The rail car according to claim 6 wherein said attachment means includes second bolt means extending through said second portion of said connection means and said vertical face of said upper chord.

8. The rail car according to claim 7 wherein said attachment means further included third bolt means extending through said third portion of said connection means, said longitudinal wall of said side stake and said side sheet.

* * * * *

UNITED STATES PATENT AND TRADEMARK OFFICE

CERTIFICATE OF CORRECTION

PATENT NO. : 5,335,603

DATED : Aug. 9, 1994

INVENTOR(S) : Cloyd Wirick and Joseph Majcher

It is certified that error appears in the above-identified patent and that said Letters Patent is hereby corrected as shown below:

Col. 4, line 13 After "chord," insert --said connection means further having a third portion in contact with said vertical face of said upper chord,--.

Signed and Sealed this

First Day of November, 1994

Bruce Lehman

*Attest:*

BRUCE LEHMAN

*Attesting Officer*

*Commissioner of Patents and Trademarks*